US007306049B2

(12) United States Patent
Soika et al.

(10) Patent No.: US 7,306,049 B2
(45) Date of Patent: Dec. 11, 2007

(54) MODE CHANGE SWITCH FOR POWER TOOL

(75) Inventors: Martin Soika, Idstein (DE); Andreas Hanke, Bad Camberg (DE); Uwe Nemetz, Hünfelden Nauheim (DE); Michael Kunz, Dorndorf (DE)

(73) Assignee: Black & Decker Inc., Newark, DE (US)

( * ) Notice: Subject to any disclaimer, the term of this patent is extended or adjusted under 35 U.S.C. 154(b) by 0 days.

(21) Appl. No.: 11/314,559

(22) Filed: Dec. 21, 2005

(65) Prior Publication Data

US 2006/0137888 A1 Jun. 29, 2006

(30) Foreign Application Priority Data

Dec. 23, 2004 (GB) ..... 0428210.9
May 27, 2005 (GB) ..... 0510935.0

(51) Int. Cl.
*E21D 6/00* (2006.01)
*E21D 6/04* (2006.01)
*E21D 1/38* (2006.01)

(52) U.S. Cl. ..... 173/49; 173/48; 173/109; 173/201

(58) Field of Classification Search ..... 173/48, 173/109, 200, 201, 49; 408/124
See application file for complete search history.

(56) References Cited

U.S. PATENT DOCUMENTS 3,589,488 A 6/1971 Clements
3,828,863 A * 8/1974 Bleicher et al. ..... 173/48
4,020,935 A 5/1977 Mortensen
4,529,044 A 7/1985 Klueber et al.
4,627,299 A 12/1986 Mortensen
4,719,976 A 1/1988 Bleicher et al.
4,732,217 A 3/1988 Bleicher et al.
4,763,733 A 8/1988 Neumaier
4,998,588 A 3/1991 Manschitz
5,111,889 A 5/1992 Neumaier
5,277,259 A 1/1994 Schmid et al.
5,320,177 A 6/1994 Shibata et al.
D349,101 S 7/1994 Schaeffer (Continued)

FOREIGN PATENT DOCUMENTS

DE 101 51 699 A1 5/2002

(Continued)

*Primary Examiner*—Rinaldi I. Rada
*Assistant Examiner*—Nathaniel Chukwurah
(74) *Attorney, Agent, or Firm*—Michael P. Leary; Charles E. Yocum; Adan Ayala

(57) ABSTRACT

A gear wheel is rotatably mounted on a drive shaft. The drive shaft has a plurality of longitudinal splines formed thereon. A drive sleeve surrounds the drive shaft and has a plurality of the inner splines formed on its interior surface. The inner splines slidably intermesh with outer splines of the drive shaft such that the drive sleeve can slide up and down on but cannot rotate relative to the drive shaft. A coil spring biases the drive sleeve downwardly. Drive sleeve teeth are formed around the bottom edge of the drive sleeve. Corresponding gear plate teeth are formed on the upper surface of the gear wheel and are adapted to engage the drive sleeve teeth when the drive sleeve is in its downward most position under the influence of the coil spring. In this position, the gear wheel is operatively coupled to the drive shaft.

15 Claims, 5 Drawing Sheets

U.S. PATENT DOCUMENTS

| | | | |
|---|---|---|---|
| 5,337,835 | A | 8/1994 | Bohne et al. |
| 5,373,905 | A | 12/1994 | Bleicher et al. |
| 5,379,848 | A | 1/1995 | Rauser |
| 5,456,324 | A | 10/1995 | Takagi et al. |
| 5,541,379 | A | 7/1996 | Kim |
| D395,586 | S | 6/1998 | Arakawa et al. |
| 5,842,527 | A | 12/1998 | Arakawa et al. |
| 6,015,017 | A | 1/2000 | Lauterwald |
| 6,035,945 | A | 3/2000 | Ichijyou et al. |
| 6,142,242 | A | 11/2000 | Okumura et al. |
| 6,176,321 | B1 | 1/2001 | Arakawa et al. |
| 6,192,996 | B1 | 2/2001 | Sakaguchi et al. |
| 6,478,095 | B2 | 11/2002 | Neumaier |
| 6,510,903 | B2 | 1/2003 | Funfer |
| 6,520,267 | B2 | 2/2003 | Funfer |
| 6,550,546 | B2 | 4/2003 | Thurler et al. |
| 6,557,648 | B2 | 5/2003 | Ichijyou et al. |
| 6,619,149 | B2 | 9/2003 | Funfer |
| 6,665,923 | B2 | 12/2003 | Phillips et al. |
| 6,712,156 | B2 | 3/2004 | Funfer |
| 6,739,405 | B2 | 5/2004 | Plietsch |
| 6,971,455 | B2 | 12/2005 | Shibata et al. |
| 2002/0112943 | A1 | 8/2002 | Funter |

FOREIGN PATENT DOCUMENTS

| | | |
|---|---|---|
| EP | 1 234 640 A1 | 8/2002 |
| GB | 2 232 372 A | 12/1990 |
| WO | WO 98/47670 | 10/1998 |

* cited by examiner

MODE CHANGE SWITCH FOR POWER TOOL

FIELD OF THE INVENTION

The present invention relates to a power tool. The invention relates particularly, but not exclusively, to a mode change mechanism for selecting a hammering mode, a rotary mode, and a combined hammering and rotary mode, and to a power tool incorporating such a mode change mechanism.

BACKGROUND OF THE INVENTION

Hammers drills are power tools which can operate in one of three modes of operation. Generally, a hammer drill will have a tool bit which can be operated in a hammering mode, a rotary mode and a combined hammering and rotary mode.

Hammer drills also generally comprise a mode change mechanism which enables a user to select between the different modes of operation of the hammer drill.

European patent application EP0759342 discloses a hammer drill having a mode change mechanism comprising an axially slidable lock ring which is disposed on the spindle of the hammer drill. The rotational mode of the hammer drill is selected by rotating an eccentric pin which moves the lock ring in the axial direction long the spindle in order to couple or decouple the lock ring from a tool holder to selectively cause rotation of the tool holder.

U.S. Pat. No. 5,456,324 discloses a hammer drill having a rotatable drive cylinder containing a hollow piston, the drive cylinder adapted to hold a tool bit such that the tool bit can be used in both a rotary mode and a reciprocating mode. A drive wheel is rotatably mounted on the drive cylinder, the drive wheel being geared to the motor of the tool. A coupling sleeve is key coupled to the drive cylinder so that the coupling sleeve can slide axially along the drive cylinder and also rotate with the drive cylinder. Both the coupling sleeve and the drive wheel have sets of teeth formed thereon such that they can intermesh. When the coupling sleeve is slid along the drive cylinder under the influence of a coil spring such that the teeth and the coupling sleeve and the teeth on the drive wheel intermesh, rotational motion is transmitted to the drive sleeve. The movement of the coupling sleeve along the spindle is accomplished by contact with an eccentrically mounted pin disposed on a rotating knob.

U.S. Pat. No. 5,379,848 comprises a hammer drill having a rotary drive sleeve comprising a tool holder, and an axially displaceable switching sleeve that can slide along the spindle in order to selectively couple the rotary drive sleeve to the rotational drive of a motor. The switching sleeve is biased into an operative position by a coil spring, and is moved by an eccentrically mounted pin.

U.S. Pat. No. 5,125,461 discloses a hammer drill having a stop element which in a first position permits axial displacement for the activation of the hammer mechanism, and a second position in which the stop element blocks the axial displacement, thus preventing the hammering action of the hammer drill.

U.S. Pat. No. 6,557,648 discloses a hammer drill having a motor with a rotary drive shaft, a housing accommodating the motor therein, and a mode change mechanism comprising a first gear with a claw portion and engaged with the drive shaft for transmitting rotation of the drive shaft, and a second gear having a claw portion and engaged with the drive shaft for transmitting rotation of the drive shaft. The mode change mechanism comprises a first drive sleeve having a claw portion enageable with the claw portion of the first gear for transmitting rotation of the drive shaft when the claw portion of the first sleeve is engaged with the claw portion of the first gear, a crank shaft driven in response to the rotation of the first drive sleeve, and a hammer mechanism responsive to the rotation of the reciprocating drive shaft for transmitting a reciprocating striking force to a tool bit. The mode change mechanism comprises a second drive sleeve having a claw portion enageable with the claw portion of the second gear for transmitting rotation of the drive shaft when the claw portion of the second sleeve is engaged with the claw portion of the second gear, a rotary drive shaft driven in response to the rotation of the second drive sleeve, and a rotary mechanism responsive to rotation of the rotary drive shaft for transmitting a rotational force to the tool bit. The mode change mechanism further comprises a switching mechanism for selectively engaging or disengaging the claw portion of the first drive sleeve with or from the claw portion of the first gear and also selectively engaging or disengaging the claw portion of the second drive sleeve with or from the claw portion of the second gear.

The switching mechanism includes a rotatable switching lever with two eccentric pins. One pin is for moving the first drive sleeve upwards and the other pin is for moving a shift member upwards so as to engage with, and move upwards, the second drive sleeve. The shift member is slideably mounted on a switch assist shaft substantially parallel to the crank shaft and rotary shaft. A spring biases the shift member downwards. This is in addition to the springs that bias the first and second drive sleeves downwards so that their claw portions engage the claw portions of the first and second gears, respectively. Therefore, the switching mechanism is a relatively complex system involving several moving parts which make it expensive to manufacture and assemble.

Preferred embodiments of the present invention seek to overcome the above disadvantages of the prior art.

BRIEF SUMMARY OF THE INVENTION

According to an aspect of the present invention, there is provided a hammer drill having a motor with a rotary drive shaft, a housing accommodating the motor therein, and a mode change mechanism comprising a first gear with a claw portion and engaged with the drive shaft for transmitting rotation of the drive shaft, a second gear having a claw portion and engaged with the drive shaft for transmitting rotation of the drive shaft, a first drive sleeve having a claw portion enageable with the claw portion of the first gear for transmitting rotation of the drive shaft when the claw portion of the first sleeve is engaged with the claw portion of the first gear, a reciprocating drive shaft driven in response to the rotation of the first drive sleeve, a hammer mechanism responsive to the rotation of the crank shaft for transmitting a reciprocating striking force to a tool bit, a second drive sleeve having a claw portion enageable with the claw portion of the second gear for transmitting rotation of the drive shaft when the claw portion of the second sleeve is engaged with the claw portion of the second gear, a rotary shaft driven in response to the rotation of the second drive sleeve, a rotary mechanism responsive to rotation of the rotary drive shaft for transmitting a rotational force to the tool bit and a switching mechanism for selectively engaging or disengaging the claw portion of the first drive sleeve with or from the claw portion of the first gear and also selectively engaging or disengaging the claw portion of the second drive sleeve with or from the claw portion of the second gear, characterised in that the switching mechanism comprises a seesaw lever pivotally connected to the housing, the seesaw lever being pivotable about an axis substantially perpendicular to the axes of the reciprocating drive shaft and rotary drive shaft, the seesaw lever having first and second engaging portions disposed on opposite sides of the axis, wherein the first engaging portion is adapted to engage the first drive sleeve such that the seesaw lever is pivotable to disengage the claw portion of the first drive sleeve from the claw portion of the first gear and the second engaging portion is adapted to engage the second drive sleeve such that the seesaw lever is pivotable to disengage the claw portion of the second drive sleeve from the claw portion of the second gear.

The seesaw lever simplifies the switching mechanism because it is one single component that can control the position of the first and second drive sleeves simultaneously.

Preferably, the mode change mechanism further comprises a first biasing means adapted to bias the claw portions of the first drive sleeve and the first gear into engagement and a second biasing means adapted to bias the claw portions of the second drive sleeve and the second gear into engagement. Thus, the claw portions are normally in engagement and the engaging portions of the seesaw lever need only abut the drive sleeves in a direction opposing to the bias of these biasing means in order to control the position of the drive sleeves. This has the advantage of simplifying the construction of the seesaw lever and the drive sleeves because the need for complex linkages between the seesaw lever and drive sleeves is eliminated.

Preferably, the first and second drive sleeves have the shape of a hat with a flange protruding radially. This has the advantage that the engaging portions of the seesaw lever need only abut the underside of the flanges of the drive sleeves which is a simple construction. It has the further advantage that the engaging portions can be shaped to neatly surround the drive sleeves by abutting the majority of the underside of the flanges thereby providing more solid support for the drive sleeves.

Preferably the switching mechanism further comprises a control plate rotatably connected to the housing, a control finger connected to the control plate and protruding outwardly therefrom towards the seesaw lever wherein the control finger protrudes through at least one elongate slot in the seesaw lever, wherein the control finger is located eccentrically in relation to the rotational axis of the control plate and the elongate slot is located eccentrically in relation to the pivotal axis of the seesaw lever so that rotation of the control plate results in pivotal movement of the seesaw lever from one side to the other. This has the advantage that control plate has positive control of the seesaw lever because the control finger is always captive inside the elongate slot. This avoids the need for extra components like, for example, springs, to return the seesaw lever to one position or another. Further, the sliding movement of the control finger inside the elongate slot neatly converts rotational movement of the control plate into bi-directional pivotal movement of the seesaw level which, in turn, selectively moves the first or the second drive sleeve along their respective linear paths. This is achieved without any additional linkages which results in a simple and compact switching mechanism. It also means that the switching mechanism does not need any stops because the seesaw lever pivots from side to side whether the control plate is rotated clockwise or anti-clockwise. This has the advantage of further simplifying the switch mechanism and saving cost.

Preferably, the recprocating drive shaft has a plurality of longitudinal outer splines formed thereon and the first drive sleeve surrounding the recprocating drive shaft and has a plurality of longitudinal inner splines formed on its interior surface wherein the inner and outer splines slidably mesh so that the first drive sleeve can slide up and down the recprocating drive shaft but the first drive sleeve cannot rotate relative to the recprocating drive shaft.

Preferably, the rotary drive shaft has a plurality of longitudinal outer splines formed thereon and the second drive sleeve surrounding the rotary drive shaft and has a plurality of longitudinal inner splines formed on its interior surface wherein the inner and outer splines slidably mesh so that the second drive sleeve can slide up and down the rotary drive shaft but the second drive sleeve cannot rotate relative to the rotary drive shaft.

Preferably, the outer and the inner splines are parallel to the axis of the reciprocating or rotary drive shafts.

Alternatively, the outer and the inner splines of the second drive sleeve and the second drive shaft, respectively, are inclined to the axis of the rotary drive shaft. Thus, these inner and the outer splines are "helical splines". When too much torque is applied to the first drive sleeve it can slide up the splines against the bias of the second biasing means so that the primary drive sleeve teeth and the gear plate teeth disengage. This effectively disconnects the rotary mechanism from the motor. As such, the helical splines arrangement provides a simple and compact torque overload clutch within the mode change mechanism.

Preferably, the claw portions of the first gear and the first drive sleeve comprise a circular array of primary drive sleeve teeth formed upon one end of the first drive sleeve and a corresponding circular array of gear teeth formed upon a facing surface of the first gear whereby the primary drive sleeve teeth are enageable with the gear teeth for transmitting rotation of the first gear to the reciprocating drive shaft. Also, the claw portions of the second gear and the second drive sleeve comprise a circular array of primary drive sleeve teeth formed upon one end of the second drive sleeve and a corresponding circular array of gear teeth formed upon a facing surface of the second gear whereby the primary drive sleeve teeth are enageable with the gear teeth for transmitting rotation of the second gear to the rotary shaft.

Preferably, a circular array of secondary drive sleeve teeth is formed upon an opposite end of the second drive sleeve and a corresponding array of housing teeth is formed upon a portion of the housing facing the secondary drive sleeve teeth, whereby the secondary drive sleeve teeth are enageable with the housing teeth for locking the rotary drive shaft against free rotation when the mode change mechanism has selected hammering only mode.

Preferably, a circular array of secondary drive sleeve teeth is formed upon an opposite end of the first drive sleeve and a corresponding array of housing teeth is formed upon a portion of the housing facing the secondary drive sleeve teeth, whereby the secondary drive sleeve teeth are enageable with the housing teeth for locking the reciprocating drive shaft against free rotation when the mode change mechanism has selected rotary only mode.

Preferably, the rotary mechanism comprises a first bevel gear connected to the top end of the second drive shaft and a second bevel gear connected to a main spindle of the hammer drill, whereby the first bevel gear meshes with the second bevel gear to transmit rotation of the second drive shaft to the main spindle.

Preferably, the hammering mechanism comprises a crank plate having a crank pin disposed eccentrically thereon connected to the top end of the first drive shaft and a hollow piston having a ram disposed slidably therein mounted to the housing, whereby a crank arm is pivotally connected to the crank pin and the hollow piston so that rotation of the crank plate causes reciprocation of the hollow piston which in turn causes reciprocation of the ram relative to the hollow piston.

BRIEF DESCRIPTION OF THE DRAWINGS

A preferred embodiment of the present invention will now be described, by way of example only and not in any limitative sense, with reference to the accompanying drawings in which:—

DETAILED DESCRIPTION OF THE INVENTION

Figure 1:
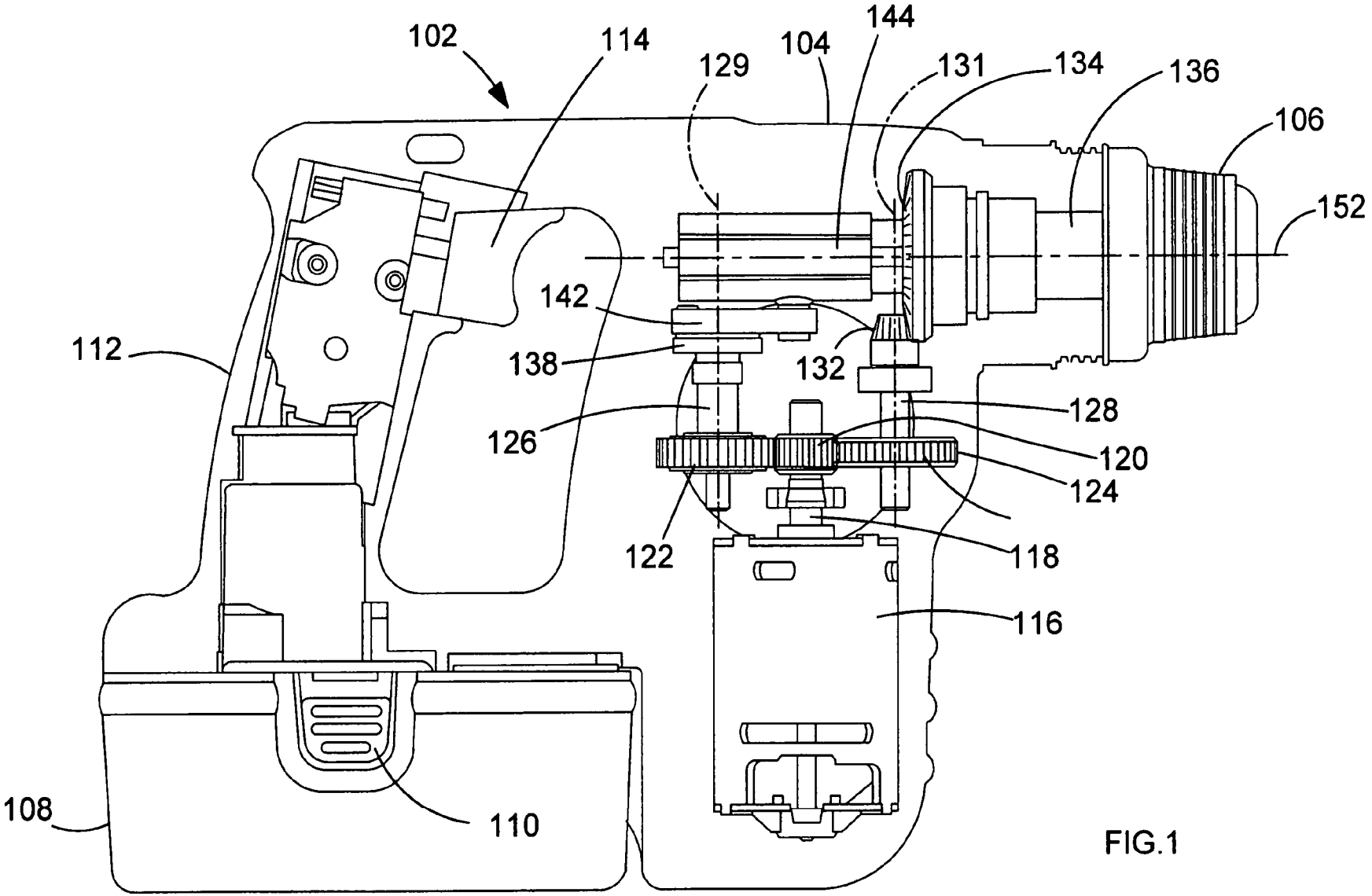
FIG. 1 is a cross sectional view of a hammer drill capable of operating in rotary mode and in hammering mode.

Referring to FIG. 1, a hammer drill shown generally by 102 comprises a housing 104 formed from at least two clamshell halves of durable plastics material, as will be understood by persons skilled in the art. Extending from a forward end of housing 104 is a chuck 106 or similar device for gripping a drill bit (not shown). A rechargeable battery pack 108 is detachably fixed to the bottom of the housing, and can be detached from the housing 104 by depressing clips 110 to release the battery pack for the purpose of recharging or exchange. The housing 104 comprises a handle portion 112 having a trigger switch 114. An electric motor 116 is disposed in the housing. The motor is electrically coupled to the battery pack via the trigger switch. The trigger switch is for selectively energising the motor to operate the hammer drill. An output shaft 118 extends from the motor 116. The output shaft 118 has a pinion 120 formed thereon. The pinion 120 meshes with a first gear 122 and a second gear 124.

When the motor 116 is energised, the drive shaft 118 and pinion 120 rotate. The pinion drives the first gear 122 and the second gear 124 simultaneously. The first gear 122 is mounted upon and freely rotatable about the lower end of a first drive shaft 126. The second gear 124 is mounted upon and freely rotatable about the lower end of the second drive shaft 128. The first drive shaft is mounted within the housing for rotation about its axis 129. Likewise, the second drive shaft is mounted within the housing for rotation about its axis 131. The first and second drive shaft axes 129, 131 are parallel to each other. Alternatively, the pinion 120 can mesh with one of the first gear 122 or the second gear 124 which, in turn, meshes with the other of the first gear 122 or the second gear 124. This is a simple way of reversing the rotation of the first and second gears 122, 124 relative to each other, if required.

Figure 3:
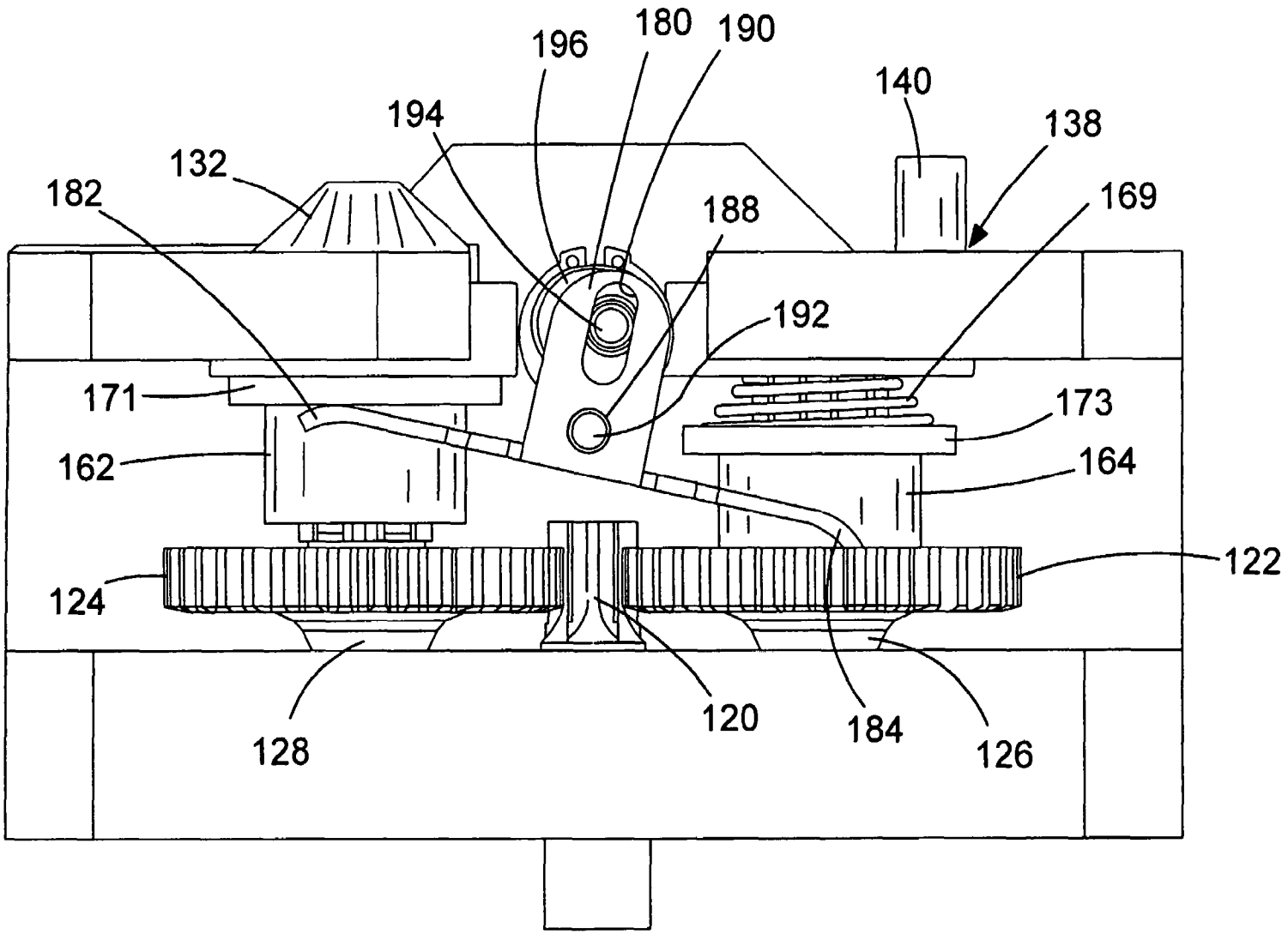
FIG. 3 is a side view of a mode change mechanism embodying the present invention in which the hammer mode is selected.

Referring to FIG. 3, a crank plate 138 is connected to the top end of the first drive shaft 126. The crank plate has a crank pin 140 protruding upwards. The crank pin is located eccentrically in relation to the axis of the first drive shaft and the crank plate. Returning to FIG. 1, the crank pin is pivotally coupled to a crank arm 142 which is pivotally coupled to a hollow piston 144 with a cylindrical internal cavity. As a result, rotation of first drive shaft 126 causes the hollow piston 144 to reciprocate back and forth along an axis 152. A cylindrical ram (not shown) is disposed within the cylindrical cavity of the hollow piston. The rectilinear reciprocating motion of the hollow piston causes the ram member to reciprocate under an air spring effect of the air contained by the walls the ram and the cylindrical cavity of the hollow piston. The reciprocating ram member repeatedly strikes the rear end of a drill bit (not shown) held in the chuck 106 which provides the hammering mode operation of the hammer drill. This type of mechanism will be well known to persons skilled in the art, and will not be described in any more detail.

A first bevel gear 132 is connected to the top end of the second drive shaft 128. The first bevel gear 132 rotates with the second drive shaft 128. A second bevel gear 134 is connected to a main spindle 136. The second bevel gear rotates with the main spindle. The main spindle, the hollow piston and the ram all have the same axis 152. The main spindle 136 is mounted in the housing for rotation about the axis 152. The first bevel gear 132 meshes with the second bevel gear 134 so that rotation of first bevel gear is transmitted to the main spindle via the second bevel gear. This provides the rotary mode operation of the hammer drill. This type of mechanism will also be well known to persons skilled in the art and will not be described in any more detail herein.

Referring now to FIGS. 2 to 5, the operation of a mode change mechanism for selecting between the hammering mode, the rotary mode and the combined hammering and rotary mode of the hammer drill will now be described in more detail.

The second drive shaft 128 has a plurality of longitudinal outer splines 160 formed thereon. A second drive sleeve 162 surrounds second drive shaft 128 and has a plurality of longitudinal inner splines 166 formed on its interior surface. The outer and the inner splines 160, 162 are parallel to the axis 131 of the second drive shaft 128. The inner splines 166 slidably mesh with outer splines 160 such that the second drive sleeve 162 can slide up and down the second drive shaft but it cannot rotate relative to the second drive shaft. A coil spring 168 is fixed at one end to a portion 170 of the housing 104. The other end of the coil spring 168 slidably engages an upper surface of a flange 171 of the second drive sleeve 162. As a result, the coil spring 168 biases second drive sleeve 162 downward. However, the second drive sleeve 162 can still rotate without restriction from the coil spring 168.

A circular array of primary drive sleeve teeth 172 is formed upon a bottom edge of the second drive sleeve 162. A corresponding circular array of gear plate teeth 174 is formed upon a top surface of the second gear 124. The primary drive sleeve teeth mesh with the gear plate teeth when the second drive sleeve 162 is moved into its lowermost position under the influence of the coil spring 168. Rotation of the second gear 124 is thus transmitted to the second drive shaft 128 via the meshed inner and outer splines 160, 166.

Figure 2:
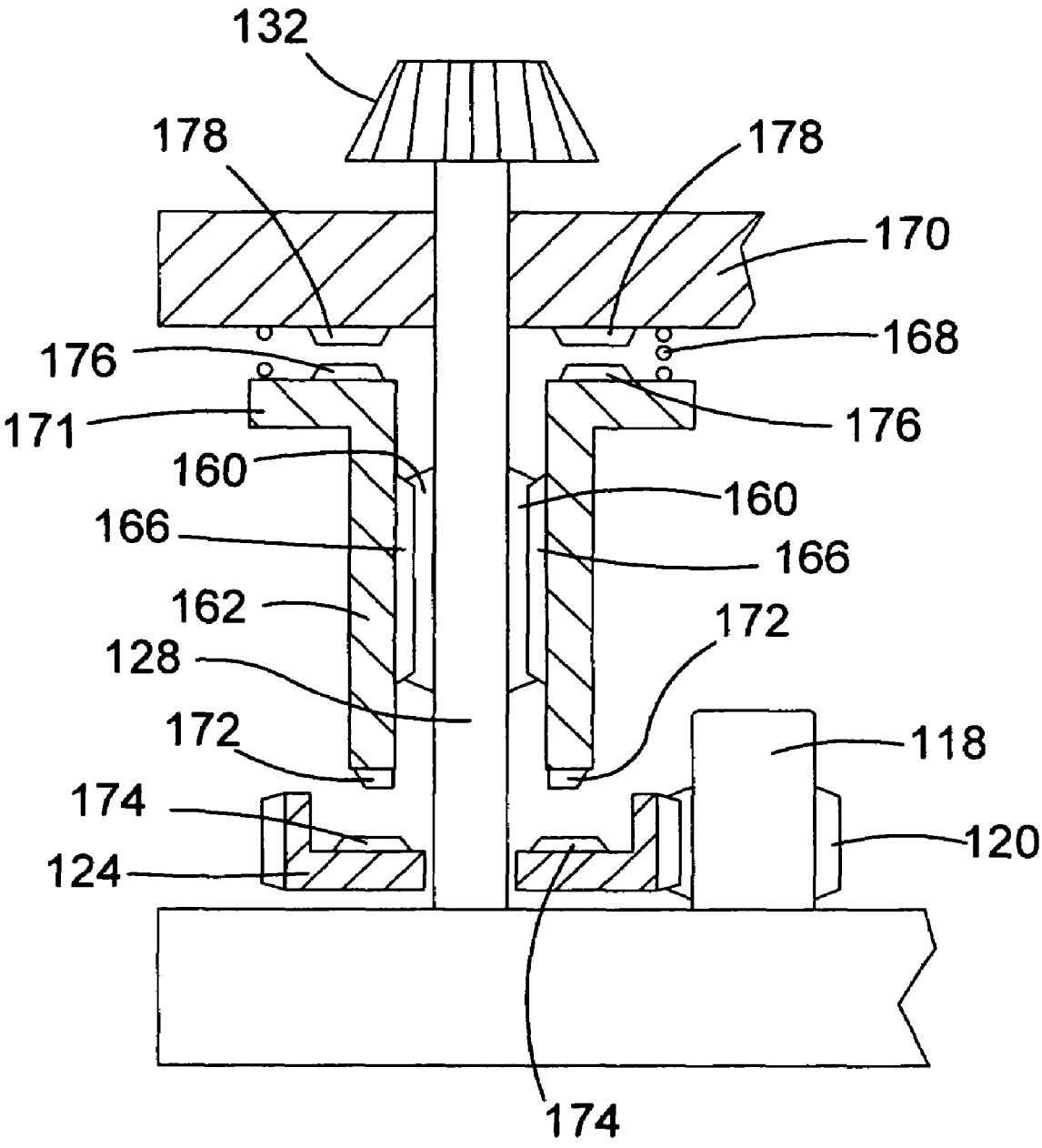
FIG. 2 is a cross sectional view of part of a mode change mechanism embodying the present invention for use in the hammer drill of FIG. 1.

If rotation of second drive shaft 128 it not required the second drive sleeve 162 must be moved upwardly into a position where the primary drive sleeve teeth 172 cannot mesh with the gear plate teeth 174. This is shown in FIG. 2 where the second drive shaft 128 is not engaged with second gear 124 and will not rotate therewith.

A circular array of secondary drive sleeve teeth 176 is formed upon the top surface of the flange 171. A corresponding array of housing teeth 178 is formed upon the bottom of the housing portion 170. The secondary drive sleeve teeth mesh with the housing teeth when the second drive sleeve 162 is moved into its uppermost position against the influence of the coil spring 168. The second drive sleeve 162 is thus locked and the meshed inner and outer splines 160, 166 prevent free rotation of the second drive shaft 128 when the mode change mechanism has selected hammering only mode. In an alternative embodiment the teeth 176 are replaced by a detent mounted on the housing portion 170 which can engage with recesses in the second drive sleeve 162 when the latter is moved into its uppermost position.

Figure 4:
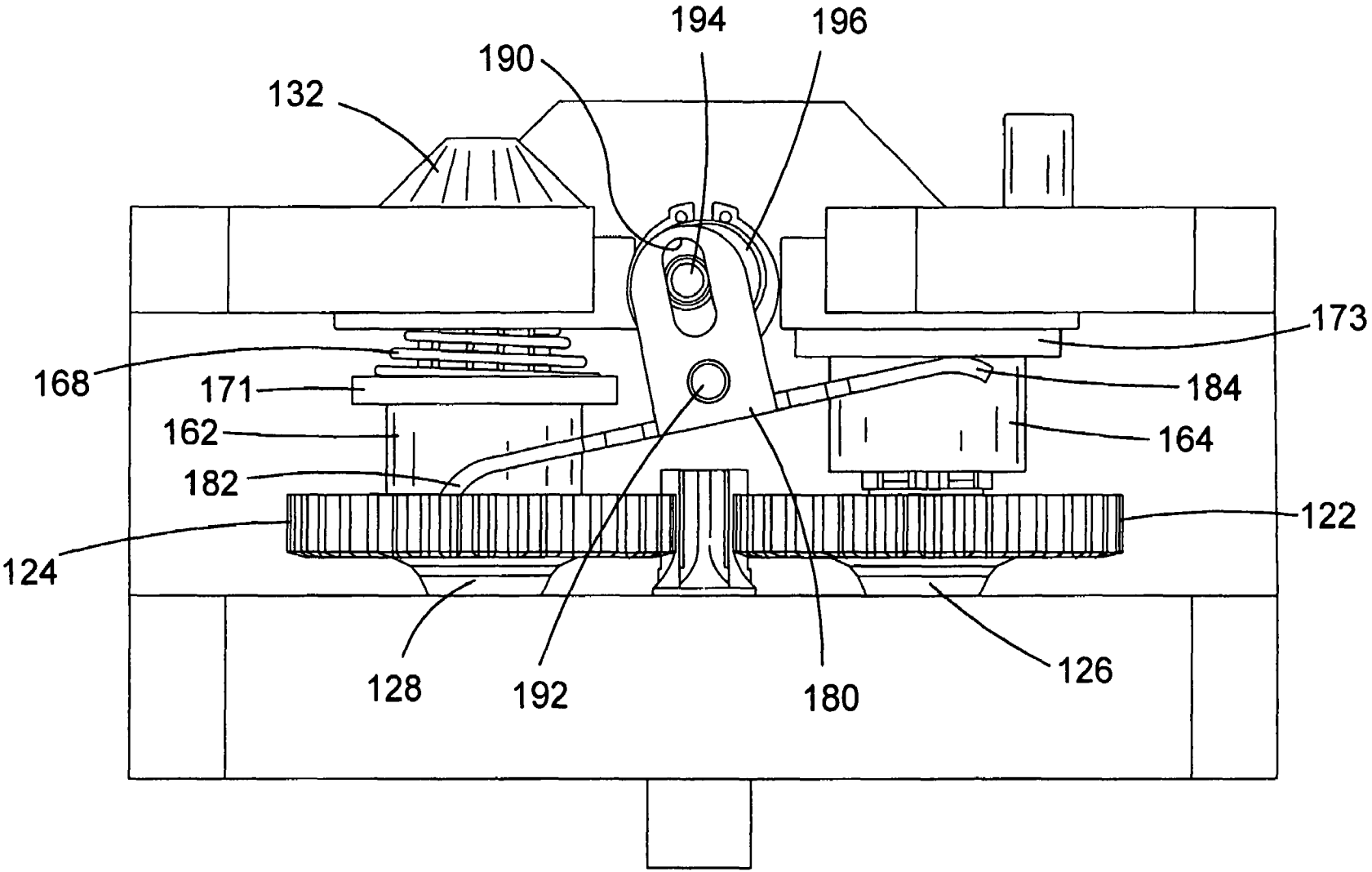
FIG. 4 is a side view of the mode change mechanism of FIG. 3 in which the rotary mode is selected.
Figure 5:
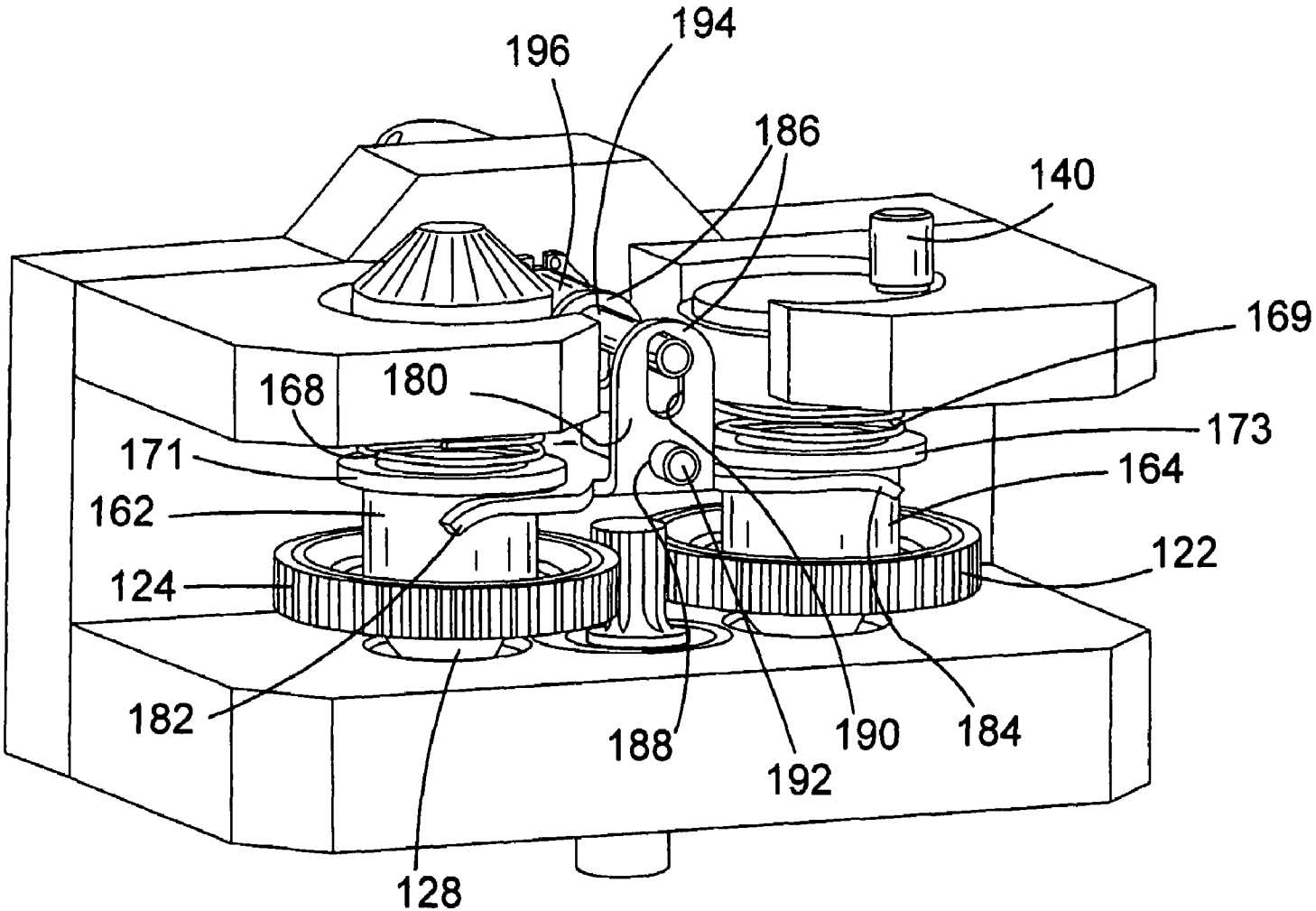
FIG. 5 is a perspective view of the mode change mechanism of FIG. 3 in which the hammer and rotary modes of the power tool are both selected.

The first drive shaft 126 is provided with a first drive sleeve 164 and the two components operate in exactly the same way as the second drive sleeve 162 on the second drive shaft 128. The first drive sleeve is a replica of the second drive sleeve. In particular, the first drive sleeve has a flange 173 corresponding to the flange 171 of the second drive sleeve, as is shown in FIGS. 3 to 5. The first drive shaft is almost a replica of the second drive shaft, the only difference being that the crank plate 138 is connected to the top end of the first drive shaft (instead of the first bevel gear 132), as is mentioned above.

In an alternative embodiment, the inner and outer splines 160, 166 of the second drive shaft and drive sleeve 128, 162 are inclined to the axis 131 of the second drive sleeve i.e. the inner and the outer splines 160, 166 are "helical splines". Thus, when too much torque is applied to the second drive sleeve 162 it can slide up the splines 160, 162 against the bias of the coil spring 168 so that the primary drive sleeve teeth 172 and the gear plate teeth 174 disengage. This effectively disconnects the main spindle 136 from the drive shaft 118 of the motor 116. As such, the helical splines arrangement provides a simple and compact torque overload clutch within the mode change mechanism. The point at which the main spindle 136 is disconnected from the drive shaft 118 of the motor 116 is influenced by the spring co-efficient of the coil spring 168 and/or the angle of inclination of the inner and outer splines 160, 166 to the axis 131.

Referring to FIGS. 3 to 5, a switching mechanism for the mode change mechanism has a seesaw lever 180 comprising a C-shaped first bracket 184 on one side and a C-shaped second bracket 182 on the other side. The first and second brackets are arranged with their open ends facing in opposite directions. The first bracket surrounds a portion of the first drive sleeve 164 and is arranged to abut the underside of its flange 173. Likewise, the second bracket surrounds a portion of the second drive sleeve 162 and is arranged to abut the underside of its flange 171.

Referring to FIG. 5, the seesaw lever 180 further comprises pair of pivot plates 186 located between the first and second brackets and extending perpendicularly therefrom. Each pivot plate 186 comprises a circular aperture 188 through which a cylindrical pin 192 passes. The pin is fixed to the housing 104. The pin 192 is the pivotal axis of seesaw lever 180.

Each pivot plate 186 further comprises an elongate slot 190 through which a control finger 194 passes. The elongate slot is generally parallel to the axes 129,131 of the first and second drive shafts 126, 128, although it can rock from side to side when the seesaw lever pivots about the pin 192, as is described in below.

A cylindrical control plate 196 is rotatably fixed to the housing 104. The control finger 194 is connected to the control plate and protrudes outwardly from the control plate towards the seesaw lever. The control finger is located eccentrically in relation to the axis of the control plate. A user can rotate the control plate 196 through 360° causing the control finger to rotate therewith. The control finger's rotational movement has a component parallel to the axes 129,131 of the first and second drive shafts 126, 128 (the vertical component) and a component perpendicular to said axes (the horizontal component). The vertical component is accommodated by the control finger sliding along the elongate slot 190 because the elongate slot is generally vertical. Whereas the horizontal component causes the control finger 194 to push the pivot plates 186 to the left, or to the right, causing the seesaw lever 180 to pivot about the pin 192 one way, or the other. Therefore, the control plate can be operated to change the seesaw lever from a position tilting towards the first drive shaft 126, as shown in FIG. 3; to a position generally perpendicular to the axes 129,131 of the first and second drive shafts 126, 128, as shown in FIG. 5; and a position tilting towards the second drive shaft 128, as shown in FIG. 4.

Referring to FIG. 3, the seesaw lever is tilted towards the first drive shaft so that the first bracket 184 is in its lowermost position and does not abut the flange 173. The first drive sleeve 164 is moved downwards under the influence of coil spring 169 so that the first drive shaft 126 is engaged with the first gear 122 via the first drive sleeve 164. Thus, rotation of the first gear 122 results in rotation of the crank pin 140 and activation of the hammering mode of the hammer drill. At the same time, the second bracket 182 is moved into its uppermost position and abuts the flange 171. The second drive sleeve 162 is moved upwards by the second bracket 182 against the influence of the coil spring 169 so that the second drive shaft 128 is disengaged from the second gear 124. Instead, the secondary drive sleeve teeth 176 mesh with the housing teeth 178. This prevents the second drive shaft 128 from rotating and prevents the first bevel gear 132 from driving the rotary mode of the hammer drill.

Referring to FIG. 5, the control plate 196 has been rotated 90° anti-clockwise from the position shown in FIG. 3 so that the seesaw lever 180 is moved to a position generally perpendicular to the axes 129,131 of the first and second drive shafts 126, 128. The first and second brackets 182, 184 are moved into their middle position and each bracket gently abuts a respective flange 171,173. The second drive sleeve 162 is moved downwards under the influence of the coil spring 169 so that the second drive shaft 128 is engaged with the first gear 124. The first drive sleeve 164 remains in the position shown in FIG. 3 so that the first drive shaft 126 remains engaged with the first gear 122. Thus, rotation of the second gear 124 rotates of the first bevel gear 132 and the rotation of the first gear 122 rotates the crank pin 140 to drive the combined rotary and hammering mode of the hammer drill.

Referring to FIG. 4, the control plate 196 has been rotated 90° anti-clockwise from the position shown in FIG. 5 so that the seesaw lever is tilted towards the second drive shaft 128. The second bracket 182 is in its lowermost position and does not abut the flange 171. The second drive sleeve 162 is moved downwards under the influence of coil spring 169 so that the second drive shaft 128 is engaged with the second gear 124 via the second drive sleeve 162. Thus, rotation of the second gear 124 results in rotation of the first bevel gear 132 and activation of the rotary mode of the hammer drill. At the same time, the first bracket 184 is moved into its uppermost position and abuts the flange 173. The first drive sleeve 164 is moved upwards by the first bracket 184 against the influence of the coil spring 169 so that the first drive shaft 126 is disengaged from the first gear 124. Instead, the secondary drive sleeve teeth 176 mesh with the housing teeth 178. This prevents the first drive shaft 126 from rotating and prevents the crank pin 140 from driving the hammering mode of the hammer drill.

In an alternative embodiment, one of the first bracket 184 or the second bracket 182 can be deleted from the seesaw lever 180 so that the mode change mechanism can operate in two modes only. If the first bracket 184 is deleted then the first drive sleeve 164 and the first gear 122 remain permanently engaged so that hammering mode cannot be deselected by the user i.e. rotary only mode is unavailable. Conversely, if the second bracket 182 is deleted then the second drive sleeve 162 and the second gear 124 remain permanently engaged so that rotary mode cannot be deselected by the user i.e. hammering only mode is unavailable. This design option may be adopted without altering other aspects of the mode change mechanism, as described above. This design option may be attractive in countries where usage conditions mean that one of the modes is rarely used and the reduction in weight and cost caused by this modification makes it viable.

It will be appreciated by persons skilled in the art that the above embodiment has been described by way of example only and not in any limitative sense, and that various alterations and modifications are possible without departure from the scope of the invention as defined by the appended claims.

The invention claimed is:

1. A hammer drill having:

a motor with a drive shaft;

a housing accommodating the motor therein; and a mode change mechanism comprising:

a first gear with a first claw portion and engaged with the drive shaft for transmitting rotation of the drive shaft;

a second gear having a second claw portion and engaged with the drive shaft for transmitting rotation of the drive shaft;

a first drive sleeve having a third claw portion enageable with the first claw portion of the first gear for transmitting rotation of the drive shaft when the third claw portion of the first drive sleeve is engaged with the first claw portion of the first gear;

a reciprocating drive shaft driven in response to the rotation of the first drive sleeve;

a hammer mechanism responsive to the rotation of the reciprocating drive shaft for generating a reciprocating striking force;

a second drive sleeve having a fourth claw portion enageable with the second claw portion of the second gear for transmitting rotation of the drive shaft when the fourth claw portion of the second sleeve is engaged with the second claw portion of the second gear;

a rotary drive shaft driven in response to the rotation of the second drive sleeve;

a rotary mechanism responsive to rotation of the rotary drive shaft for transmitting a rotational force to a main spindle; and a switching mechanism for selectively engaging or disengaging the third claw portion of the first drive sleeve with or from the first claw portion of the first gear and also selectively engaging or disengaging the fourth claw portion of the second drive sleeve with or from the second claw portion of the second gear, characterised in that the switching mechanism comprises a seesaw lever pivotally connected to the housing, the seesaw lever being pivotable about a pivot axis substantially perpendicular to the reciprocating drive shaft and the rotary drive shaft, the seesaw lever having a first engaging portion and a second engaging portion disposed on opposite sides of the pivot axis, wherein the first engaging portion is adapted to engage the first drive sleeve such that the seesaw lever is pivotable to disengage the third claw portion of the first drive sleeve from the first claw portion of the first gear and the second engaging portion is adapted to engage the second drive sleeve such that the seesaw lever is pivotable to disengage the fourth claw portion of the second drive sleeve from the second claw portion of the second gear.

2. A hammer drill according to claim 1, wherein the mode change mechanism further comprises a first biasing means adapted to bias the third claw portion of the first drive sleeve and the first claw portion of the first gear into engagement and a second biasing means adapted to bias the fourth claw portion of the second drive sleeve and the second claw portion of the second gear into engagement.

3. A hammer drill according to claim 2, wherein the first drive sleeve includes a cylindrical portion defining an annular bore, the cylindrical portion having a first end, and the first drive sleeve further including a radial flange portion attached to the cylindrical portion at the first end.

4. A hammer drill according to claim 3, wherein the reciprocating drive shaft has a plurality of longitudinal outer splines formed thereon and the first drive sleeve surrounds the reciprocating drive shaft and the cylindrical portion of the first drive sleeve includes an interior surface and a plurality of longitudinal inner splines formed on the interior surface, and wherein the inner splines and the outer splines slidably mesh so that the first drive sleeve can slide up and down the reciprocating drive shaft but the first drive sleeve cannot rotate relative to the reciprocating drive shaft.

5. A hammer drill according to claim 1, wherein the switching mechanism further comprises:

a control plate rotatably connected to the housing and defining a rotational axis;

a control finger connected to the control plate and protruding outwardly therefrom towards the seesaw lever; and wherein the control finger protrudes through an elongate slot in the seesaw lever, wherein the control finger is located eccentrically in relation to the rotational axis of the control plate and the elongate slot is located eccentrically in relation to the pivot axis of the seesaw lever so that rotation of the control plate results in pivotal movement of the seesaw lever.

6. A hammer drill according to claim 1, wherein the second drive sleeve includes a cylindrical portion having an interior surface and a plurality of longitudinal inner splines formed on the interior surface, the cylindrical portion having a first end, and the second drive sleeve further including a radial flange portion attached to the cylindrical portion at the first end, and the rotary drive shaft has a plurality of longitudinal outer splines formed thereon and the second drive sleeve surrounds the rotary drive shaft, and wherein the inner splines and the outer splines slidably mesh so that the second drive sleeve can slide up and down the rotary drive shaft but the second drive sleeve cannot rotate relative to the rotary drive shaft.

7. A hammer drill according to claim 6, wherein the outer splines and the inner splines are parallel to the axis of the rotary drive shaft.

8. A hammer drill according to claim 6, wherein the outer splines and the inner splines are inclined to the axis of the rotary drive shaft.

9. A hammer drill according to claim 1, wherein the first claw portion of the first gear comprises a circular array of gear teeth formed upon a facing surface of the first gear, and the third claw portion of the first drive sleeve comprises a corresponding circular array of primary drive sleeve teeth formed upon a first end of the first drive sleeve, and whereby the primary drive sleeve teeth are enageable with the gear teeth for transmitting rotation of the first gear to the reciprocating drive shaft.

10. A hammer drill according to claim 9, wherein a circular array of secondary drive sleeve teeth is formed upon a second end of the first drive sleeve opposite to the first end of the first drive sleeve, and a corresponding array of housing teeth is formed upon a portion of the housing facing the secondary drive sleeve teeth, and whereby the secondary drive sleeve teeth are enageable with the housing teeth for locking the reciprocating drive shaft against free rotation when the mode change mechanism has selected rotary only mode.

11. A hammer drill according to claim 1, wherein the second claw portion of the second gear comprises a circular array of gear teeth formed upon a facing surface of the second gear, and the fourth claw portion of the second drive sleeve comprise a corresponding circular array of primary drive sleeve teeth formed upon a first end of the second drive sleeve, and whereby the primary drive sleeve teeth are enageable with the gear teeth for transmitting rotation of the second gear to the rotary drive shaft.

12. A hammer drill according to claim 11, wherein a circular array of secondary drive sleeve teeth is formed upon a second end of the second drive sleeve opposite to the first end of the second drive sleeve, and a corresponding array of housing teeth is formed upon a portion of the housing facing the secondary drive sleeve teeth, and whereby the secondary drive sleeve teeth are enageable with the housing teeth for locking the rotary drive shaft against free rotation when the mode change mechanism has selected hammering only mode.

13. A hammer drill according to claim 1, wherein the rotary mechanism comprises a first bevel gear connected to a first end of the rotary drive shaft and a second bevel gear connected to the main spindle, whereby the first bevel gear meshes with the second bevel gear to transmit rotation of the rotary drive shaft to the main spindle.

14. A hammer drill according to claim 1, wherein the hammering mechanism comprises a crank plate connected to a first end of the reciprocating drive shaft, the crank plate having a crank pin disposed eccentrically thereon, and a hollow piston slidably mounted within the housing, and a ram disposed slidably within the hollow piston, and a crank arm is pivotally connected between the crank pin and the hollow piston whereby rotation of the crank plate causes reciprocation of the hollow piston, which in turn causes reciprocation of the ram relative to the hollow piston.

15. A hammer drill having:

a motor with a drive shaft;

a housing accommodating the motor therein; and a mode change mechanism comprising:

a first gear with a first claw portion and engaged with the drive shaft for transmitting rotation of the drive shaft;

a second gear having a second claw portion and engaged with the drive shaft for transmitting rotation of the drive shaft;

a first drive sleeve having a third claw portion enageable with the first claw portion of the first gear for transmitting rotation of the drive shaft when the third claw portion of the first drive sleeve is engaged with the first claw portion of the first gear;

a reciprocating drive shaft driven in response to the rotation of the first drive sleeve;

a hammer mechanism responsive to the rotation of the reciprocating drive shaft for generating a reciprocating striking force;

a second drive sleeve having a fourth claw portion enageable with the second claw portion of the second gear for transmitting rotation of the drive shaft when the fourth claw portion of the second sleeve is engaged with the second claw portion of the second gear;

a rotary drive shaft driven in response to the rotation of the second drive sleeve;

a rotary mechanism responsive to rotation of the rotary drive shaft for transmitting a rotational force to a main spindle; and a switching mechanism for selectively engaging or disengaging the third claw portion of the first drive sleeve with or from the first claw portion of the first gear and also selectively engaging or disengaging the fourth claw portion of the second drive sleeve with or from the second claw portion of the second gear, characterised in that the switching mechanism comprises:

a control plate rotatably connected to the housing and defining a rotational axis;

a seesaw lever pivotally connected to the housing, the seesaw lever being pivotable about a pivot axis substantially perpendicular to the reciprocating drive shaft and the rotary drive shaft, the seesaw lever including an elongate slot located eccentrically in relation to the pivot axis of the seesaw lever, and the seesaw lever further including a first engaging portion and a second engaging portion disposed on opposite sides of the pivot axis from the first engaging portion;

a control finger connected to the control plate and protruding axially outwardly from the control plate towards the seesaw lever, and the control finger protrudes through and movably engages the elongate slot in the seesaw lever so that rotation of the control plate results in pivotal movement of the seesaw lever; and wherein the first engaging portion is adapted to movably engage the first drive sleeve such that when the seesaw lever is in a first position the third claw portion of the first drive sleeve is disengaged from the first claw portion of the first gear, and the second engaging portion is adapted to movably engage the second drive sleeve such that the when the seesaw lever is in a second position the fourth claw portion of the second drive sleeve is disengaged from the second claw portion of the second gear.

* * * * *